US005850970A

United States Patent [19]

Hull et al.

[11] Patent Number: 5,850,970

[45] Date of Patent: Dec. 22, 1998

[54] PREFABRICATED EMBEDDED RAILWAY TRACK SYSTEM

[76] Inventors: William K. Hull, 1705 Jamestown; Thomas A. Hogue, 702 Williamsburg, both of Ennis, Tex. 75119

[21] Appl. No.: 839,850

[22] Filed: Apr. 17, 1997

Related U.S. Application Data

[62] Division of Ser. No. 471,844, Jun. 6, 1995, Pat. No. 5,655, 711.

[51] Int. Cl.[6] ..... E01B 2/00

[52] U.S. Cl. ..... 238/8

[58] Field of Search ..... 238/2, 3, 4, 5, 238/6, 7, 8, 9

[56] References Cited

U.S. PATENT DOCUMENTS

| | | | |
|---|---|---|---|
| 1,612,274 | 12/1926 | Fischer . | |
| 1,720,187 | 7/1929 | Nagel | 238/9 |
| 2,835,451 | 5/1958 | Goulding | 238/8 |
| 2,929,562 | 3/1960 | Hosbein | 238/8 |
| 2,950,057 | 8/1960 | Speer | 238/8 |
| 3,353,747 | 11/1967 | Speer | 238/8 |
| 4,093,120 | 6/1978 | Canfield | 238/8 |
| 4,236,670 | 12/1980 | Limmergard et al. | 238/8 |
| 4,368,845 | 1/1983 | Perry et al. | 238/8 |
| 4,415,120 | 11/1983 | Thim | 238/8 |
| 4,461,421 | 7/1984 | Maass | 238/8 |
| 4,606,498 | 8/1986 | Grant et al. | 238/8 |
| 4,793,545 | 12/1988 | Raymond | 238/8 |
| 4,846,401 | 7/1989 | Kennel | 238/8 |
| 4,880,158 | 11/1989 | Cook | 238/8 |
| 4,899,933 | 2/1990 | Martin | 238/8 |
| 4,899,993 | 2/1990 | Martin | 238/8 |
| 5,181,657 | 1/1993 | Davis | 238/8 |
| 5,201,467 | 4/1993 | Kennel et al. | 238/8 |
| 5,282,569 | 2/1994 | Kiyota | 238/8 |
| 5,535,947 | 7/1996 | Hogue et al. | 238/8 |

FOREIGN PATENT DOCUMENTS

| | | | |
|---|---|---|---|
| 357617 | 8/1906 | France | 238/9 |
| 1012628 | 3/1952 | Germany | 238/8 |
| 3602313 | 7/1987 | Germany | 238/7 |
| 1633052A1 | 8/1988 | U.S.S.R. | 238/9 |

OTHER PUBLICATIONS

Epton Industries, Inc., "Epflex Railseal Interface" Apr. 14, 1988.

OMNI Rubber Products, Inc., Drawing: Railguard Rubber/ Concrete Grade Crossing System Drawing, Aug. 31, 1991.

Extrud–A–Rail Inc., p. 39, Railway Age. Feb. 1991.

Magnum Manufacturing Corp., Drawings, date unknown.

*Primary Examiner*—Mark Tuan Le

*Attorney, Agent, or Firm*—Jenkens & Gilchrist, P.C.

[57] ABSTRACT

An embedded railway panel is prefabricated with an insert formed around a first section of a reinforcing member, and a panel member formed around a second section of the reinforcing member. The reinforcing member secures the insert to the panel member and provides structural rigidity for both the insert and the panel. A rail of a railway track and the prefabricated embedded railway panel are positioned such that the insert of the prefabricated embedded railway panel is adjacent to the rail, and the top surface of the panel of the prefabricated embedded railway panel at substantially the same height as the top of the panel.

3 Claims, 3 Drawing Sheets

PREFABRICATED EMBEDDED RAILWAY TRACK SYSTEM

This application is a divisional of application Ser. No. 08/471,844, filed on Jun. 6, 1995, now U.S. Pat. No. 5,655,711.

BACKGROUND

1. Field of the Invention

The present invention relates to railway track assemblies, and more particularly, to embedded railway track assemblies.

2. History of the Related Art

Railway track assemblies typically employ a pair of steel rails supported by a plurality of perpendicularly disposed ties which rest on a ballast material. Often it is desirous to embed the railway tracks so that the top surface of the rails are substantially the same height as the finish grade of the surrounding surface.

A standard method of embedding railway tracks is to assemble forms around the railway tracks, and then the surrounding surface is built up around the railway tracks within the forms. After the surrounding surface is built up, the forms are removed and inserts are installed in gaps between the rails of the railway track and the surrounding surface.

However, this method requires the on site building and removal of custom forms for each section of the railway track that is to be embedded. Also, extra steps are necessary to install inserts between the rails of the railway tracks and the surrounding surface.

For the foregoing reasons, there is a need for embedded railway track systems which reduce the need to build and remove on site custom forms for each section of the railway track to be embedded, and which reduce the steps of assembling a completed embedded railway system.

SUMMARY

In accordance with one embodiment of the present invention there is provided a reinforcing member, an insert, and a panel member. A first section of the reinforcing member is secured within the insert such that the reinforcing member provides structural rigidity for the insert. A second section of the reinforcing member is secured within said panel such that the reinforcing member provides structural rigidity for the panel member. In a further embodiment, the present invention includes a support bracket attached to the panel member and providing support to a lower side of the insert. In yet another further embodiment, the panel member includes a recess having a lower surface and an inner wall which provide support to the insert. In yet another further embodiment, the reinforcing member has a third section which extends from the insert and forms a rail side of the panel member. In yet another further embodiment, the present invention includes a supporting member with a first section of the supporting member secured within the insert, and a second section of the supporting member forming a rail side of the panel member. In a further aspect, the first section of the supporting member provides support for the first section of the reinforcing member. In yet another further embodiment, the panel member, the insert, and the reinforcing member have a curvature matching a turning curvature of the railway track. In yet another further embodiment, the present invention includes a second reinforcing member secured within a second insert, and the second reinforcing member being secured within the panel member.

In another embodiment, the present invention is a method having the steps of prefabricating an embedded railway panel and positioning the prefabricated railway panel. The embedded railway panel is prefabricated by securing a first section of a reinforcing member within an insert, and securing a second section of the reinforcing member within a panel member. The prefabricated embedded railway panel is positioned with the insert being adjacent to a rail of a railway track and the top of the panel member being at substantially the same height as the top of the rail. In a further embodiment, the step of prefabricating includes securing a support bracket to a rail side of the panel member for providing support to a lower surface of the insert. In another further embodiment, the step of prefabricating includes forming the panel member with a recess, wherein a lower and an inner surface of the recess provide support to a lower and inner surface of said insert. In another further embodiment of the present invention, the step of prefabricating includes forming a rail side of the panel member from a third section of the reinforcing member which extends from the insert. In another further embodiment, the step of prefabricating includes securing a first section of a supporting member within the insert, and forming a rail side of the panel member with a second section of the supporting member. In a further aspect, the step of prefabricating includes positioning the first section of the supporting member to provide support to the first section of the reinforcing member. In another further embodiment, the step of prefabricating includes forming the panel member, the insert, and the reinforcing member with a curvature matching a turning curvature of the railway track. In yet another further embodiment, the step of prefabricating includes securing a second reinforcing member within a second insert and securing the second reinforcing member within the panel member, and the step of positioning includes positioning the prefabricated embedded railway panel with the second insert being adjacent to a second rail of the railway track.

In yet another embodiment, the present invention is a method having the steps of prefabricating an embedded railway panel, and positioning the prefabricated railway panel, and positioning a rail of the railway track. The embedded railway panel is prefabricated by securing a first section of a reinforcing member within an insert, and securing a second section of the reinforcing member within a panel member. The prefabricated embedded railway panel is positioned at a location for embedding the railway track. The rail of the railway track is positioned adjacent to the insert of the prefabricated embedded railway panel with the top of the rail being at substantially the same height as the top of the panel member of the prefabricated embedded railway panel. In a further embodiment, the step of prefabricating includes securing a support bracket to a rail side of the panel member for providing support to a lower surface of the insert. In another further embodiment, the step of prefabricating includes forming the panel member with a recess, wherein a lower and an inner surface of the recess provide support to a lower and inner surface of the insert. In another further embodiment, the step of prefabricating includes forming a rail side of the panel member with a third section of the reinforcing member which extends from the insert. In another further embodiment, the step of prefabricating includes securing a first section of a supporting member within the insert, and forming a rail side of the panel with a second section of the supporting member. In a further aspect, the step of prefabricating includes positioning the first section of the supporting member to provide a support to the first section of the reinforcing member. In another further embodiment, the step of prefabricating includes forming the panel member, the insert, and the reinforcing member with a curvature matching a turning curvature of the railway track. In another further embodiment, the step of prefabricating includes securing a second reinforcing member within a second insert and securing the second reinforcing member within the panel member, and the method includes a further step of positioning a second rail of the railway track adjacent to the second insert with the top of the panel member being substantially the same height as the top of the second rail.

BRIEF DESCRIPTION OF THE DRAWINGS

These and other features will become better understood with regard to the following description, appended claims, and accompanied drawings in which:

DETAILED DESCRIPTION

Figure 1:
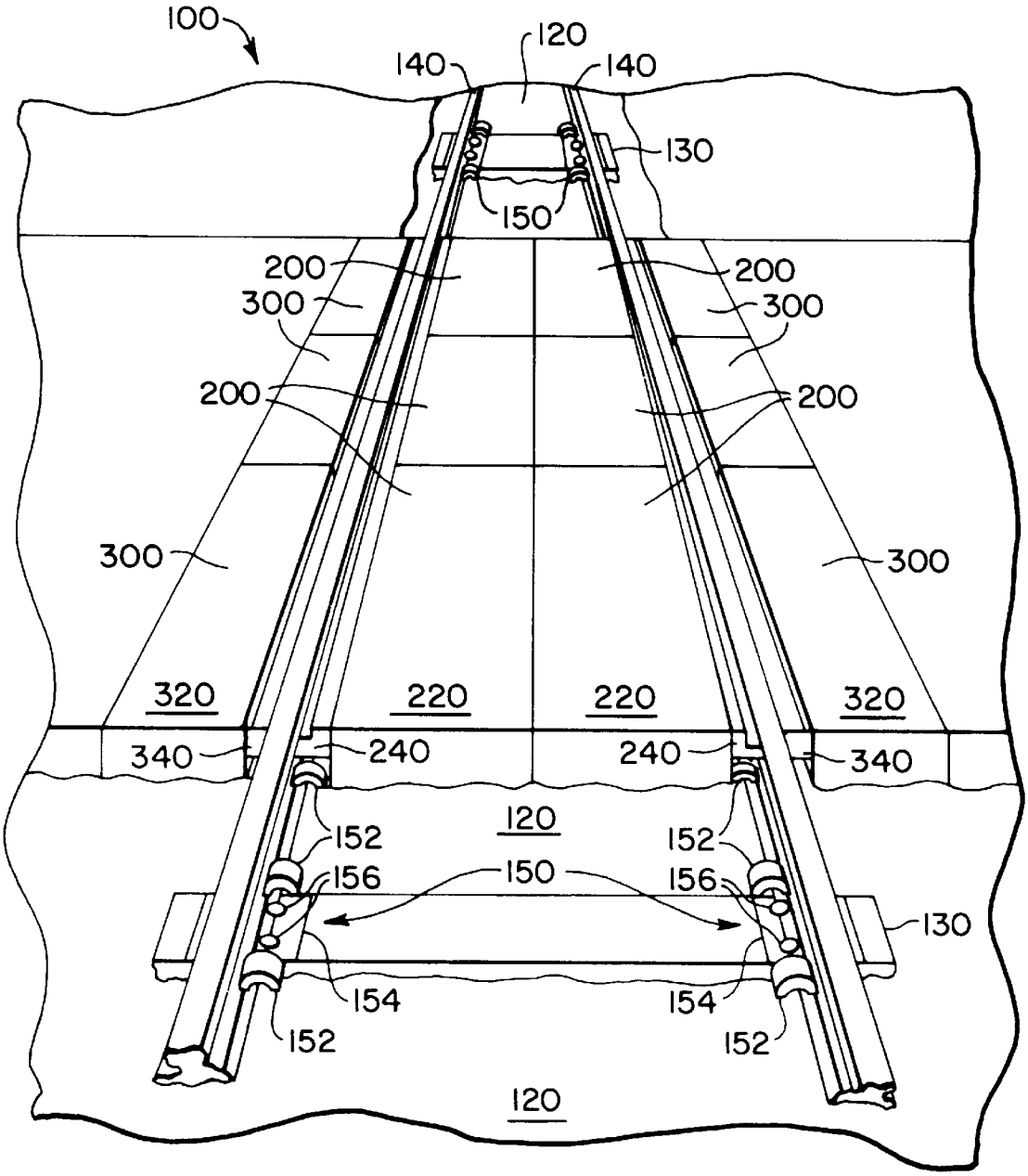
FIG. 1 shows a perspective view, from above, of an embedded railway system in accordance with one embodiment of the present invention.

Referring first to FIG. 1, there is shown a perspective view, from above, of an embedded railway system 100 constructed in accordance with one embodiment of the present invention. The embedded railway system 100 generally comprises a pair of rails 140 supported on a ballast material 120 by a row of ties 130 which are ranged substantially perpendicular to the rails 140. The ties 130 rest directly on the ballast material 120, and the rails 140 are secured to the ties 130 by hardware 150. The hardware 150 generally includes a plurality of rail anchors 152, tie plates 154, and rail fasteners 156 such as spikes or clips. Although the embodiment illustrated uses a plurality of rail anchors 152, tie plates 154, and rail fasteners 156 as the hardware 150 which secures the rails 140 to the ties 130, any fastening hardware can be used which performs the same function of securing the rails 140. The ballast material 120 is a material sufficient for supporting the ties 130, such as gravel, or the like. The ties 130 are constructed of a material strong enough to support the rails 140, and to prevent the rails 140 from shifting their position when secured by the fastening hardware 150. Typically, materials for the ties 130 include, but are not limited to, wood, concrete, or the like.

Still referring to FIG. 1, it can be seen that the embedded railway system 100 also includes gauge panels 200 and field panels 300. The gauge panels 200 include a panel member 220 and a gauge insert 240. The gauge panels 200 are located between the rails 140 with the gauge inserts 240 being positioned adjacent to the rails 140. Although FIG. 1 illustrates two gauge panels 200 each having separate panel members 220, in one embodiment of the present invention a single gauge panel is disposed between the rails 140 having a single panel member with gauge inserts on both edges for engaging each of the rails 140. In yet another embodiment of the present invention, a gap exists between the panel members 220 of the gauge panels 220 which is filled with asphalt, concrete, a steel panel, or the like. The field panels 300 have a panel member 320 and a field insert 340. The field panels 300 are located on the outside of the rails 140 with the field inserts 340 being positioned adjacent to the rails 140.

Figure 2:
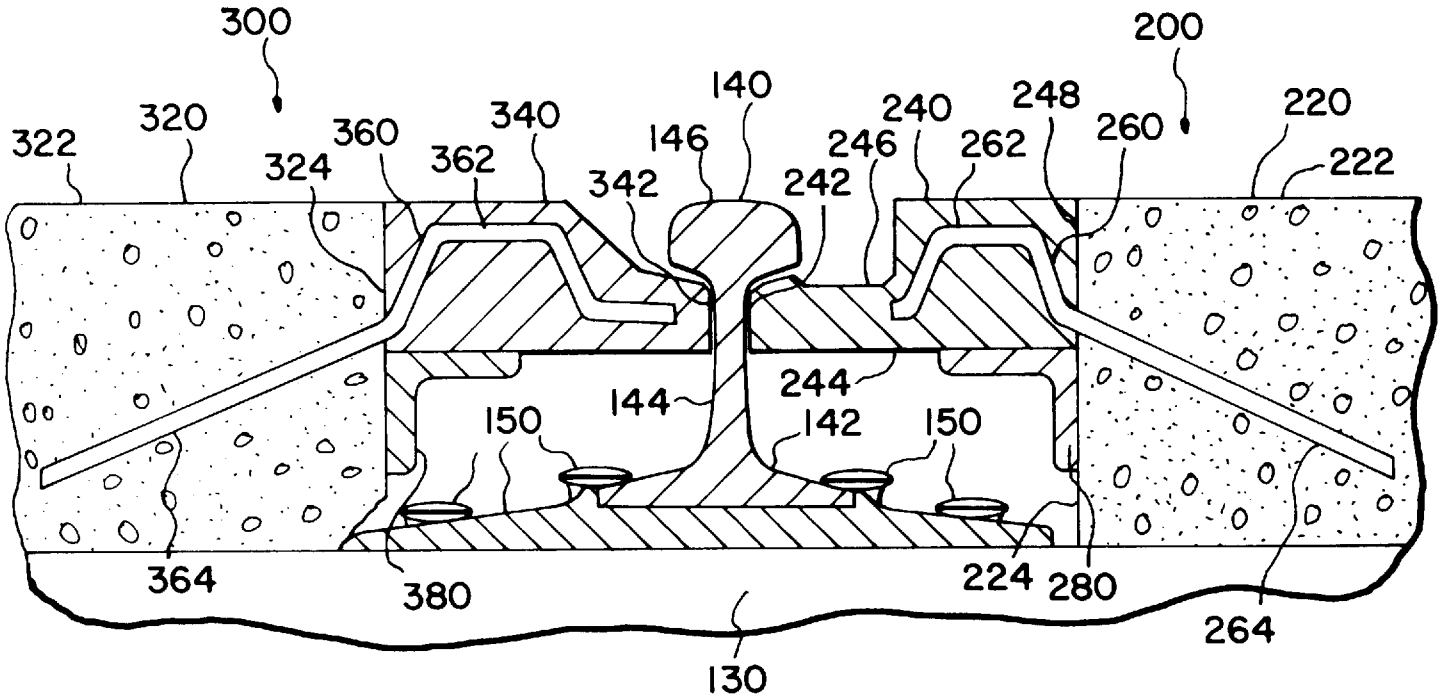
FIG. 2 shows a partial cross-sectioned view of a construction of the embodiment in FIG. 1 taken about one of the rails in FIG. 1.

Referring now to FIG. 2, there is shown a cross-sectional view of a portion around one of the rails 140 in the embedded railway system 100 of FIG. 1. The rail fastening hardware 150 secures a rail base 142 of the rail 140 to the ties 130. The rail 140 also has a rail head 146 which is connected to the rail base 142 by a rail web 144. The rail head 146 provides the area of the rail 140 for the wheels of a vehicle (not shown) traveling on the rails of a railroad track to follow. The gauge panels 200 are disposed in between the rails 140, and the field panels 300 are disposed outside of the rails 140.

Still referring to FIG. 2, the gauge panels 200 generally include a panel member 220, a gauge insert 240, a reinforcing member 260, and a support bracket 280. The reinforcing member 260 has a first section 262 and a second section 264. The first section 262 of the reinforcing member 260 is disposed within the gauge insert 240. Also, the second section 264 of the reinforcing member 260 is disposed within the panel member 220. It can be seen that the reinforcing member 260 not only secures the gauge insert 240 to the panel member 220, but also provides structural rigidity for both the panel member 220 and the gauge insert 240.

Referring still to FIG. 2, the panel member 220 has a top surface 222 which is located to be at substantially the same height as the top of the rail 140. The gauge insert occupies the space between a rail side 224 of the panel member 220 and the rail 140. The gauge insert 240 has a rail end 242 which is adapted to be longitudinally adjacent with the rail 140. Longitudinally adjacent includes contacting the rail 140, being positioned substantially close to the rail 140, or both. Near the rail end 242 of the gauge insert 240 is a recess 246 which allows a flange of the wheels on a vehicle (not shown) traveling along the rails 140, to pass without obstruction. The support bracket 280 is secured to a rail side 224 of the panel member 220, and provides support to a lower surface 244 of the gauge insert 240.

Still referring to FIG. 2, in one method of fabricating the gauge panel 200, the gauge insert 240 is formed by extruding, casting, machining, or the like. The gauge insert 240 can be formed of rubber, plastic, felt, or the like, but is preferably formed from extruded rubber. The first section 262 of the reinforcing member 260 is disposed within the gauge insert 240 by securing the first section 262 of the reinforcing member 260 within apertures in the gauge insert 240, by casting or molding the gauge inserts 240 with the first section 262 of the reinforcing member 260 therein, by extruding the gauge inserts 240 with the first section 262 of the reinforcing member 260 therein, or by similar methods.

Referring still to FIG. 2, the panel member 220 is formed of concrete, cement, asphalt, or the like. The panel member 220 is formed with the second section 264 of the reinforcing member 260 extending into the panel member 220. In this manner, the reinforcing member 260 provides structural rigidity for both the panel member 220 and the gauge insert 240, and also secures the gauge insert 240 to the rail side 224 of the panel member 220.

Still referring to FIG. 2, in one method of constructing the present invention, the first section 262 of the reinforcing member 260 is disposed within the gauge insert 240, and then the second section 264 of the reinforcing member 260 is disposed within the panel member 220. In one method of constructing the present invention, the second section 264 of the reinforcing member 260 is disposed within the panel member 220, and then the first section 262 of the reinforcing member 260 is disposed within the gauge insert 240.

Referring still to FIG. 2, to mount the support bracket 280 on the gauge panel 200, the support bracket 280 is secured to the rail side 224 of the panel member 220 at a position which provides support to the lower surface 244 of the gauge insert 260. In one construction of the present invention, the support bracket 280 is formed of angle iron, or the like, and is secured to the rail side 224 of the panel member 220 by a bolt, or welded to a bar embedded in the panel member 220, or the like.

Still referring to FIG. 2, in prefabricating the gauge panel 200, the panel member 220, the gauge insert 240, the reinforcing member 260, and the support bracket 280 are all formed to comply with any curvature in the parallel rails 140. Most embedded railway tracks occur at locations where the railway tracks are progressing in a straight run. However, often it is necessary to embed railway tracks at locations where turns exist in the railway tracks. To compensate for the curvature in the railway tracks, in one construction of the present invention, the gauge panel 200 is prefabricated with a standard railway track curvature. In one construction of the present invention, the gauge panel 200 is prefabricated with a custom curvature for a unique embedded railway track application.

Referring still to FIG. 2, in an embodiment (not shown) using a gauge panel having one panel member with two gauge inserts, the same methods and materials can be used to mount the second gauge insert with a second reinforcing member, and the second reinforcing member with an opposing edge (not shown) of the panel member 220, as can be used for mounting the gauge insert 240 with the reinforcing member 260, and for mounting the reinforcing member 260 with the panel member 220. A second support bracket can also be secured to the opposing edge of the panel member 220 for providing support to the second gauge insert in the same manner as the support bracket 280 is mounted to the panel member 220 and provides support to the gauge insert 240.

Still referring to FIG. 2, the field panel 300 generally includes a panel member 320, a field insert 340, a reinforcing member 360, and a support bracket 380. The reinforcing member 360 has a first section 362 and a second section 364. The first section 362 of the reinforcing member 360 is disposed within the field insert 340. Also, the second section 364 of the reinforcing member 360 is disposed within the panel member 320. It can be seen that the reinforcing member 360 not only secures the field insert 340 to the panel member 320, but also provides structural rigidity for both the panel member 320 and the field insert 340.

Referring still to FIG. 2, the panel member 320 has a top surface 322 which is located to be at substantially the same height as the top of the rail 140. The field insert 340 occupies the space between the panel member 320 and the rail 140. The field insert 340 has a rail end 342 which is adapted to be longitudinally adjacent with the rail 140. Longitudinally adjacent includes contacting the rail 140, being substantially close to the rail 140, or both. The support bracket 380 is secured to a rail side 324 of the panel member 320, and provides support to a lower surface 344 of the field insert 340.

Still referring to FIG. 2, in one method of fabricating the field panel 300, the field insert 340 is formed by extruding, casting, machining, or the like. The field insert 340 can be formed of rubber, plastic, felt, or the like, but is preferably formed from extruded rubber. The first section 362 of the reinforcing member 360 is disposed within the field insert 340 by securing the first section 362 of the reinforcing member 360 within apertures in the field insert 340, by casting or molding the field inserts 340 with the first section 362 of the reinforcing member 360 therein, by extruding the field inserts 340 with the first section 362 of the reinforcing member 360 therein, or by similar methods.

Referring still to FIG. 2, the panel member 320 is formed of concrete, cement, asphalt, or the like. The panel member 320 is formed with the second section 364 of the reinforcing member 360 extending into the panel member 320. In this manner, the reinforcing member 360 provides structural rigidity for both the panel member 320 and the field insert 340, and also secures the field insert 340 to the rail side 324 of the panel member 320.

Still referring to FIG. 2, in one method of constructing the present invention, the first section 362 of the reinforcing member 360 is disposed within the field insert 340, and then the second section 364 of the reinforcing member 360 is disposed within the panel member 320. In another method of constructing the present invention, the second section 364 of the reinforcing member 360 is disposed within the panel member 320, and then the first section 362 of the reinforcing member 360 is disposed within the field insert 340.

Referring still to FIG. 2, to mount the support bracket 380 on the field panel 300, the support bracket 380 is secured to the rail side 324 of the panel member 320 at a position which provides support to the lower surface 344 of the field insert 340. In one construction of the present invention, the support bracket 380 is formed of angle iron, or the like, and is secured to the rail side 324 of the panel member 320 by a bolt, or by being welded to a bar embedded in the panel member 320, or the like.

Still referring to FIG. 2, in prefabricating the field panel 300, the panel member 320, the field insert 340, the reinforcing member 360, and the support bracket 380 are all formed to comply with any curvature in the parallel rails 140. Most embedded railway tracks occur at locations where the railway tracks are progressing in a straight run. However, often it is necessary to embed railway tracks at locations where turns exist in the railway tracks. To compensate for the curvature in the railway tracks, in one construction of the present invention, the field panel 300 is prefabricated with a standard railway track curvature. In another construction of the present invention, the field panel 300 is prefabricated with a custom curvature for a unique embedded railway track application.

Figure 3:
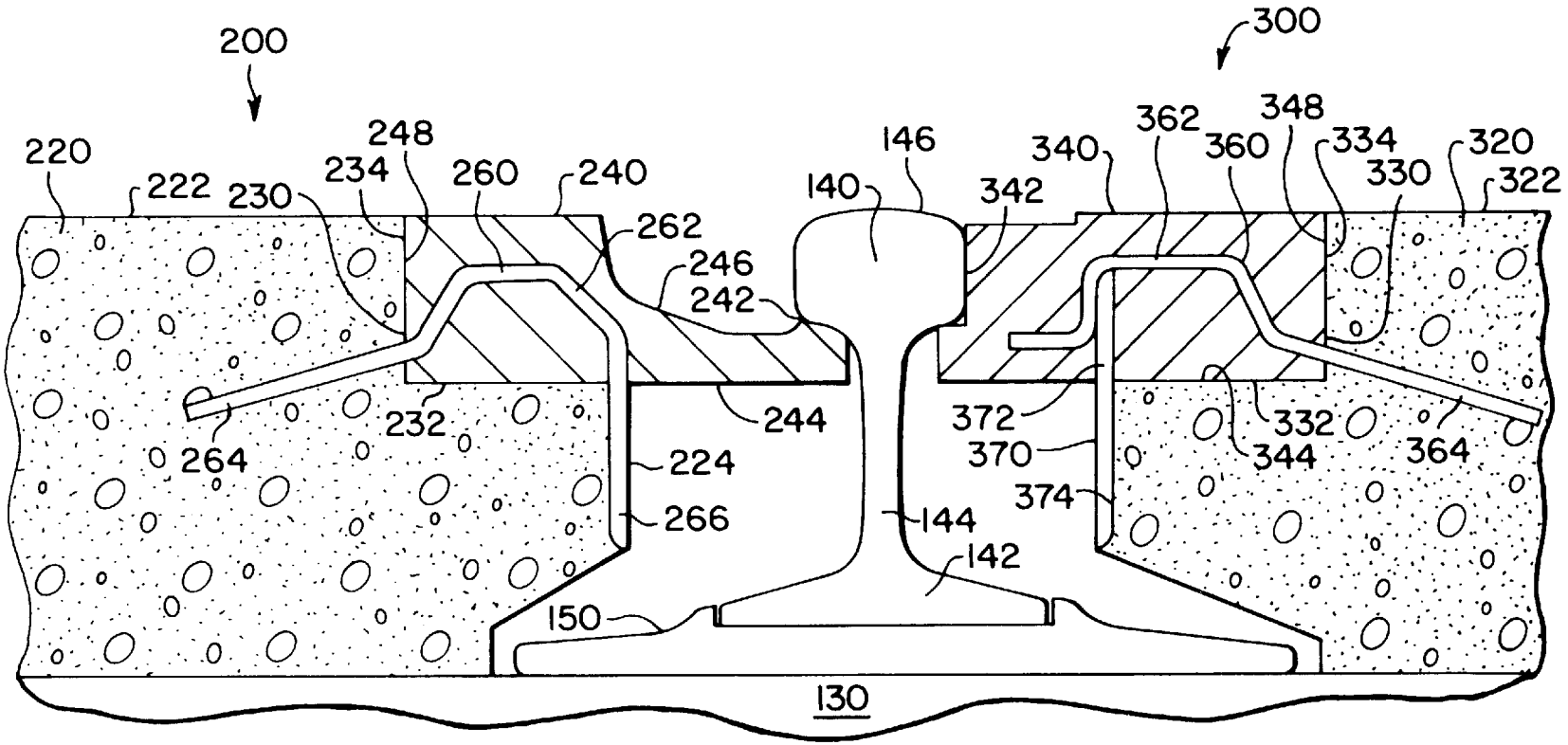
FIG. 3 shows a partial cross-sectional view of an embodiment, similar to the construction of the embodiment in FIG. 1, taken about one of the rails.

Referring now to FIG. 3, there is shown a cross-sectional view of a portion around one of the rails 140 of an alternate embodiment of the present invention which is similar in construction to the embodiment in FIG. 1. The rail fastening hardware 150 secure a rail base 142 of the rail 140 to the ties 130. The rail 140 also has a rail head 146 which is connected to the rail base 142 by a rail web 144. The rail head 146 provides the area of the rail 140 for the wheels of a vehicle (not shown) traveling on the rails of a railroad track to follow. The gauge panels 200 are disposed in between the rails 140, and the field panels 300 are disposed outside of the rails 140.

Still referring to FIG. 3, the gauge panels 200 generally include a panel member 220, a gauge insert 240, and a reinforcing member 260. The panel member 220 has a top surface 222 which is located to be at substantially the same height as the top of the rail 140. The panel member 220 also has a recess 230, with a lower surface 232 and an inner surface 234, which receives the gauge insert 240.

Referring still to FIG. 3, the gauge insert occupies the space between a rail side 224 of the panel member 220 and the rail 140. In one construction of the present invention, the gauge insert 240 has a rail end 242 which is adapted to be longitudinally adjacent with the rail 140. Longitudinally adjacent includes contacting the rail 140, being substantially close to the rail 140, or both. Near the rail end 242 of the gauge insert 240 is a recess 246 which allows a flange on the wheels of a vehicle (not shown) traveling along the rails 140, to pass without obstruction.

Still referring to FIG. 3, the lower surface 232 of the recess 230 provides vertical support to a lower surface 244 of the gauge insert 240, and the inner surface 234 of the recess 230 provides horizontal support to a panel side surface 248 of the gauge insert 240. The reinforcing member 260 has a first section 262, a second section 264, and a third section 266. The first section 262 of the reinforcing member 260 is disposed within the gauge insert 240. The second section 264 of the reinforcing member 260 is disposed within the panel member 220. The third section 266 of the reinforcing member 260 forms a rail side 224 on the panel member 220. It can be seen that the reinforcing member 260 not only secures the gauge insert 240 to the panel member 220, but also provides structural rigidity for the panel member 220, provides structural rigidity for the gauge insert 240, and forms a rail side 224 on the panel member 220.

Referring still to FIG. 3, in one method of fabricating the gauge panel 200, the gauge insert 240 is formed by extruding, casting, machining, or the like. The gauge insert 240 can be formed of rubber, plastic, felt, or the like, but is preferably formed from extruded rubber. The first section 262 of the reinforcing member 260 is disposed within the gauge insert 240 by securing the first section 262 of the reinforcing member 260 within apertures in the gauge insert 240, by casting or molding the gauge inserts 240 with the first section 262 of the reinforcing member 260 therein, by extruding the gauge inserts 240 with the first section 262 of the reinforcing member 260 therein, or by similar methods. The second section 264 of the reinforcing member 260 extends out of the gauge insert 240. The third section 266 of the reinforcing member 260 extends out of the lower surface 244 of the gauge insert 240. The reinforcing member 260 is formed of metal, composite materials, or any other material which will provide structural rigidity.

Still referring to FIG. 3, the panel member 220 is formed of concrete, cement, asphalt, or the like. The panel member 220 is formed with the second section 264 of the reinforcing member 260 extending into the panel member 220, and with the third section 266 of the reinforcing member 260 forming the rail side 224 of the panel member 220. In this manner, the reinforcing member 260 provides structural rigidity for both the panel member 220 and the gauge insert 240, and secures the gauge insert 240 to the panel member 220. Also, the third section 266 of the reinforcing member forms a rail side 224 of the panel member 220 which is stronger than the material from which the panel member 220 is formed.

Referring still to FIG. 3, in one method of constructing the present invention, the first section 262 of the reinforcing member 260 is first disposed within the gauge insert 240, and then the second section 264 and the third section 266 of the reinforcing member 260 are disposed within the panel member 220. In another method of constructing the present invention, the second section 264 and the third section 266 of the reinforcing member 260 are first disposed within the panel member 220, and then the first section 262 of the reinforcing member 260 is disposed within the gauge insert 240.

Still referring to FIG. 3, in prefabricating the gauge panel 200, the panel member 220, the gauge insert 240, and the reinforcing member 260 are all formed to comply with any curvature in the parallel rails 140. Most embedded railway tracks occur at locations where the railway tracks are progressing in a straight run. However, often it is necessary to embed railway tracks at locations where turns exist in the railway tracks. To compensate for the curvature in the railway tracks, in one embodiment of the present invention, the gauge panel 200 is prefabricated with a standard railway track curvature. In another embodiment of the present invention, the gauge panel 200 is prefabricated with a custom curvature for a unique embedded railway track application.

Referring still to FIG. 3, in an embodiment (not shown) using a gauge panel having one panel member with two gauge inserts, the same methods and materials can be used to mount the second gauge insert with a second reinforcing member, and the second reinforcing member with an opposing edge (not shown) of the panel member 220, as can be used for mounting the gauge insert 240 to the reinforcing member 260, and for mounting the reinforcing member 260 to the panel member 220.

Still referring to FIG. 3, the field panels 300 generally include a panel member 320, a field insert 340, a reinforcing member 360, and a supporting member 370. The panel member 320 has a top surface 322 which is located to be at substantially the same height as the top of the rail 140. The panel member 320 also has a recess 330, with a lower surface 332 and an inner surface 334, which receives the field insert 340. The lower surface 332 of the recess 330 provides vertical support to a lower surface 344 of the field insert 340, and the inner surface 334 of the recess 330 provides horizontal support to a panel side 348 of the field insert 340.

Referring still to FIG. 3, the field insert 340 occupies the space between a rail side 324 of the panel member 320 and the rail 140. In another construction of the present invention, the field insert 340 has a rail end 342 which is adapted to be longitudinally adjacent with the rail 140. Longitudinally adjacent includes contacting the rail 140, being substantially close to the rail 140, or both.

Still referring to FIG. 3, the reinforcing member 360 has a first section 362 and a second section 364. The first section 362 of the reinforcing member 360 is disposed within the field insert 340, and the second section 364 of the reinforcing member 360 is disposed within the panel member 320. The reinforcing member 360 is formed of metal, composite materials, or any other material which will provide structural rigidity. It can be seen that the reinforcing member 360 not only helps secure the field insert 340 to the panel member 320, but also provides structural rigidity for both the panel member 320 and the field insert 340. The supporting member 370 has a first section 372 and a second section 374. The first section 372 of the supporting member 370 is disposed within the field insert 340, and the second section 374 of the supporting member 370 forms the rail side surface 324 on the panel member 320. The support member 370 is formed of metal, composite materials, or any other material which will provide structural rigidity. It can be seen that the supporting member 370 not only helps secure the field insert 340 to the panel member 320, but also forms a rail side surface 324 on the panel member 320.

Referring still to FIG. 3, in one method of fabricating the field panel 300, the field insert 340 is formed by extruding, casting, machining, or the like. The field insert 340 can be formed of rubber, plastic, felt, or the like, but is preferably formed from extruded rubber. The first section 362 of the reinforcing member 360 is disposed within the field insert 340 by securing the first section 362 of the reinforcing member 360 within apertures in the field insert 340, by casting or molding the field inserts 340 with the first section 362 of the reinforcing member 360 therein, by extruding the field inserts 340 with the first section 362 of the reinforcing member 360 therein, or by similar methods. The second section 364 of the reinforcing member 360 extends out of the field insert 340. The first section 372 of the supporting member 370 is also disposed within the field insert 340 by securing the first section 372 of the supporting member 370 within apertures in the field insert 340, by casting the field inserts 340 with the first section 372 of the supporting member 370 therein, or by similar methods. In one construction of the present invention, the first section 372 of the supporting member 370 is also positioned to provide support to the first section 262 of the reinforcing member 260. The second section 374 of the supporting member 370 extends out of the lower surface 344 of the field insert 340.

Still referring to FIG. 3, the panel member 320 is formed of concrete, cement, asphalt, or the like. The panel member 320 is formed with the second section 364 of the reinforcing member 360 extending into the panel member 320, and with the second section 374 of the supporting member 370 forming the rail side 324 of the panel member 320. In this manner, the reinforcing member 360 provides structural rigidity for both the panel member 320 and the field insert 340. Also, the supporting member 370 also provides structural rigidity for the field insert 340, secures the field insert 340 to the panel member 320, and forms the rail side 324 of the panel member 320 which is stronger than the material from which the panel member 320 is formed.

Referring still to FIG. 3, in one method of constructing the present invention, the first section 362 of the reinforcing member 360 and the first section 372 of the supporting member 370 are first disposed within the field insert 340, and then the second section 364 of the reinforcing member 360 and the second section 374 of the supporting member 370 are disposed within and on, respectively, the panel member 320. In another method of constructing the present invention, the second section 364 of the reinforcing member 360 and the second section 374 of the supporting member 370 are first disposed within and on, respectively, the panel member 320, and then the first section 362 of the reinforcing member 360 and the first section 372 of the supporting member 370 are disposed within the field insert 340.

Still referring to FIG. 3, in prefabricating the field panel 300, the panel member 320, the field insert 340, the reinforcing member 360, and the supporting member 370 are all formed to comply with any curvature in the parallel rails 140. Most embedded railway tracks occur at locations where the railway tracks are progressing in a straight run. However, often it is necessary to embed railway tracks at locations where turns exist in the railway tracks. To compensate for the curvature in the railway tracks, in one embodiment of the present invention, the field panel 300 is prefabricated with a standard railway track curvature. In another embodiment of the present invention, the field panel 300 is prefabricated with a custom curvature for a unique embedded railway track application.

Referring now to FIGS. 1, 2, and 3 in combination, one method of constructing the embedded railway system 100 begins by prefabricating the gauge panel 200 and the field panel 300, as previously discussed. The ties 130 are located on the ballast material 120 and the parallel rails 140 are secured to the ties 130 by the hardware 150. The prefabricated gauge panels 200 and the prefabricated field panels 300 are transported to the site of the railway track that is to be embedded. The prefabricated gauge panels 200 (or a single gauge panel with two gauge inserts) are then positioned between the parallel rails 140 so that the gauge inserts 240 are adjacent to the parallel rails 140. The prefabricated field panels 300 are positioned externally of the parallel rails 140 with the field inserts 340 adjacent to the parallel rails 140. Adjacent includes contacting the rail 140, being positioned substantially close to the rail 140, or both. Once the prefabricated gauge panels 200 and the prefabricated field panels 300 are in place, slight location adjustments are made to improve the fit of the prefabricated gauge panels 200 and the prefabricated field panels 300 with the rails 140 of the railway track. If space exists between the gauge panels 200, the space is then filled with concrete, pavement, a steel plate, planks, or the like.

It is thus believed that the operation and construction of the present invention will be apparent from the foregoing description of a preferred embodiment. While the device and method shown are described as being preferred, it will be obvious to a person of ordinary skill in the art that various changes and modifications may be made therein without departing from the spirit and scope of the invention as defined in the following claims. For example, the gauge panel 200 and/or the field panels 300 can be positioned prior to locating and securing the rails 140. As another example, the gauge panel 200 can utilize a reinforcing member and a support member similar to the reinforcing member 360 and the support member 370 illustrated in FIG. 3, in place of the reinforcing member 260 in FIG. 3 or the reinforcing member 260 and support bracket 280 in FIG. 2. As yet another example, the field panel 300 can utilize a reinforcing member with a first section, a second section, and a third section similar to the reinforcing member 260 illustrated in FIG. 3, in place of the reinforcing member 360 and support bracket 380 in FIG. 2 or the reinforcing member 360 and support member 370 in FIG. 3. Therefore, the spirit and scope of the appended claims should not be limited to the description of the preferred embodiments contained herein.

What is claimed is:

1. A system for embedding a railway track comprising:

a reinforcing member having a first section and a second section;

an insert having the first section of said reinforcing member secured therein, wherein the first section of said reinforcing member provides structural rigidity to said insert;

a panel member having the second section of said reinforcing member secured therein, wherein the second section of said reinforcing member provides structural rigidity to said panel member;

wherein said reinforcing member secures said insert with said panel member; and a support bracket formed of angle iron with a first surface secured to said panel member and a second surface secured to a lower surface of said insert, wherein said support bracket provides support to said lower surface of said insert.

2. A method of embedding a railway track comprising the steps of:

prefabricating an embedded railway panel by securing a first section of a reinforcing member within an insert and securing a second section of the reinforcing member within a panel member; and positioning the prefabricated embedded railway panel with the insert being adjacent to a rail of said railway track and with the top of the panel member being at substantially the same height as the top of the rail;

wherein said step of prefabricating includes securing an angle iron support bracket to the panel member in a position which provides support to a lower surface of the insert.

3. A method of embedding a railway track comprising the steps of:

prefabricating an embedded railway panel by securing a first section of a reinforcing member within an insert, and securing a second section of the reinforcing member within a panel member;

positioning the prefabricated embedded railway panel at a location for embedding said railway track; and positioning a rail of said railway track adjacent to the insert of the embedded railway panel, with the top of the rail being at substantially the same height as the top of the panel member of the prefabricated embedded railway panel;

wherein said step of prefabricating includes securing an angle iron support bracket to the panel member in a position which provides support to a lower surface of the insert.

* * * * *